US006648981B2

(12) United States Patent
McIntyre et al.

(10) Patent No.: US 6,648,981 B2
(45) Date of Patent: Nov. 18, 2003

(54) METHODS AND SYSTEMS FOR DISHWASHER MODEL SELECTION

(75) Inventors: Michael Lee McIntyre, Cox's Creek, KY (US); Omar Haider, Louisville, KY (US)

(73) Assignee: General Electric Company, Schenectady, NY (US)

( * ) Notice: Subject to any disclaimer, the term of this patent is extended or adjusted under 35 U.S.C. 154(b) by 19 days.

(21) Appl. No.: 09/930,716

(22) Filed: Aug. 15, 2001

(65) Prior Publication Data

US 2003/0037806 A1 Feb. 27, 2003

(51) Int. Cl.[7] ..... B08B 3/02

(52) U.S. Cl. ..... 134/18; 134/56 R; 134/57 R; 134/58 R; 134/201

(58) Field of Search ..... 134/56 R, 57 R, 134/58 R, 201, 18, 25.2, 42; 68/3 R, 12.02

(56) References Cited

U.S. PATENT DOCUMENTS

| | | | | |
|---|---|---|---|---|
| 3,949,782 | A | | 4/1976 | Athey et al. |
| 4,224,530 | A | * | 9/1980 | Simcoe et al. |
| 4,245,309 | A | * | 1/1981 | Kiefer |
| 4,275,464 | A | | 6/1981 | Schmidt |
| 4,709,412 | A | * | 11/1987 | Seymour et al. |
| 5,123,018 | A | * | 6/1992 | Peterson |
| 5,366,185 | A | | 11/1994 | Michael et al. |
| 5,524,362 | A | * | 6/1996 | Quandt et al. |
| 5,611,867 | A | | 3/1997 | Cooper et al. |
| 5,960,804 | A | | 10/1999 | Cooper et al. |
| 5,998,769 | A | * | 12/1999 | Le Van Suu |

FOREIGN PATENT DOCUMENTS

| | | | |
|---|---|---|---|
| JP | 6-35113 | * | 12/1994 |
| JP | 2000-81970 | * | 3/2000 |
| JP | 2000-1994405 | * | 7/2000 |

OTHER PUBLICATIONS

European patent application 838,192 Apr. 1998.*

* cited by examiner

*Primary Examiner*—Frankie L. Stinson
(74) *Attorney, Agent, or Firm*—George L. Rideout, Jr.; Armstrong Teasdale, LLP

(57) ABSTRACT

In one aspect, a dishwasher comprising a controller coupled to a human machine interface comprising an indicator corresponding to a dishwasher model type is described. The dishwasher further comprises a cabinet comprising a tub having a front opening and forming a wash chamber, at least one rack extending into the wash chamber, a water pump for pumping water into the dishwasher, and a door engaged to the cabinet for closing the tub front opening. The controller is configured to control operation of at least the pump based on the model type indicator.

15 Claims, 3 Drawing Sheets

METHODS AND SYSTEMS FOR DISHWASHER MODEL SELECTION

BACKGROUND OF THE INVENTION

This invention relates generally to dishwashers, and, more particularly, to methods and systems determining dishwasher model.

Known dishwasher systems include a main pump assembly and a drain pump assembly for circulating and draining wash fluid within a wash chamber located in a cabinet housing. The main pump assembly feeds washing fluid to various spray arm assemblies for generating washing sprays or jets on dishwasher items loaded into one or more dishwasher racks disposed in the wash chamber.

Many different model dishwashers are commercially available, and each dishwasher model may have different structural features, operational features, and controls from other dishwasher models. For example, the number of spray arms, the types of spray, and wash cycles can vary from model to model. Different control schemes typically are used in each different dishwasher model. For example, a control scheme for two level spray dishwasher model is different from a control scheme for a three level spray dishwasher model.

Although different control schemes are used for different dishwasher models, dishwasher manufacturers typically utilize a common control board typically for most if not all dishwasher models. A typical control board includes a microprocessor coupled to a memory. The microprocessor operates under control of a program and variables stored in the memory. The program executed and the variables utilized can vary from model to model. For example, cycle times and wash instructions can vary from model to model. Utilizing a common control board across different dishwasher models facilitates inventory and cost reductions.

In order for the microprocessor to execute the correct programs utilizing the correct variables for a particular dishwasher model, a model selection input is provided to the microprocessor. However, since the control board can be utilized in many different dishwasher models, the particular dishwasher model in which a control board is installed may not be known until a late point in the manufacturing process. Therefore, at the time of loading the programs and variables into the control board memory, it is not known in which particular model dishwasher the control board will be installed.

BRIEF SUMMARY OF THE INVENTION

In one aspect, a dishwasher comprising a controller coupled to a human machine interface comprising an indicator corresponding to a dishwasher model type is described. The dishwasher further comprises a cabinet comprising a tub having a front opening and forming a wash chamber, at least one rack extending into the wash chamber, a water pump for pumping water into the dishwasher, and a door engaged to the cabinet for closing the tub front opening. The controller is configured to control operation of at least the pump based on the model type indicator.

In another aspect, a method for controlling operation of a dishwasher is described. The dishwasher comprises a controller and a human machine interface, and the human machine interface comprises an indicator corresponding to a model type. The method comprises the steps of determining a model type based on the indicator, and controlling operation of the controller in accordance with the determined model type.

In yet another aspect, a kit comprising a human machine interface for a dishwasher is described. The human machine interface comprises an indicator corresponding to a dishwasher model type.

DETAILED DESCRIPTION OF THE INVENTION

Figure 1:
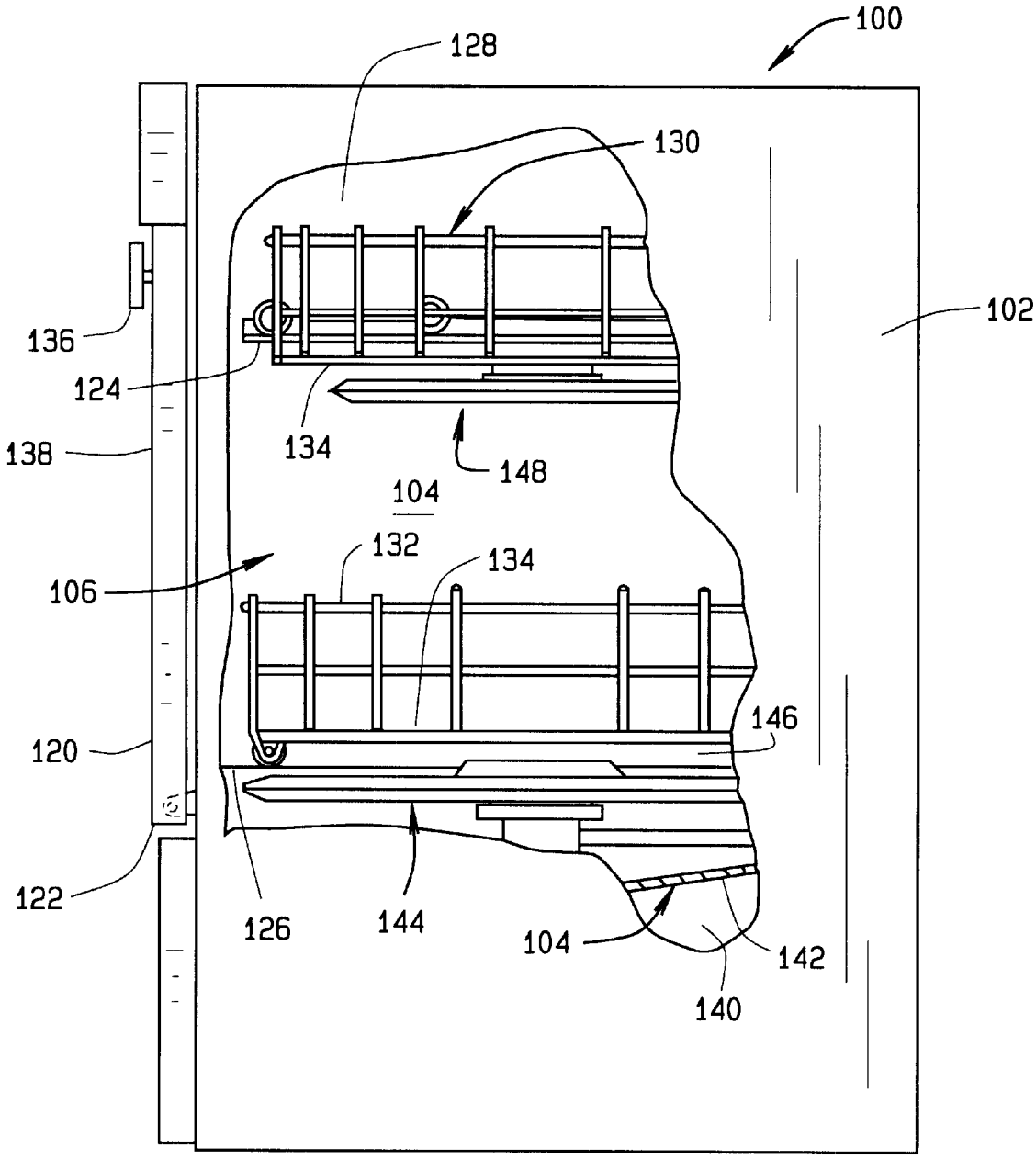
FIG. 1 a side elevational view of an example dishwasher system partially broken away.

FIG. 1 is a side elevational view of an exemplary domestic dishwasher system 100 partially broken away, and in which the present invention may be practiced. It is contemplated, however, that the invention may be practiced in other types of dishwashers and dishwasher systems other than just dishwasher system 100 described and illustrated herein. Accordingly, the following description is for illustrative purposes only, and the invention is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein wash chamber is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is mounted at a convenient location on an outer face 138 of door 120 and is coupled to known control circuitry (not shown) and control mechanisms such as a control board (not shown) for operating a fluid circulation assembly (not shown in FIG. 1) for circulating water and dishwasher fluid in dishwasher tub 104. Selector 136 sometimes is referred to herein as a Human Machine Interface (HMI) 136. Typically, a different HMI 136 is utilized for different dishwasher models since the inputs required from a user vary from model to model.

The fluid circulation assembly is located in a machinery compartment 140 located below a bottom sump portion 142 of tub 104, and its construction and operation is explained in detail below. A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
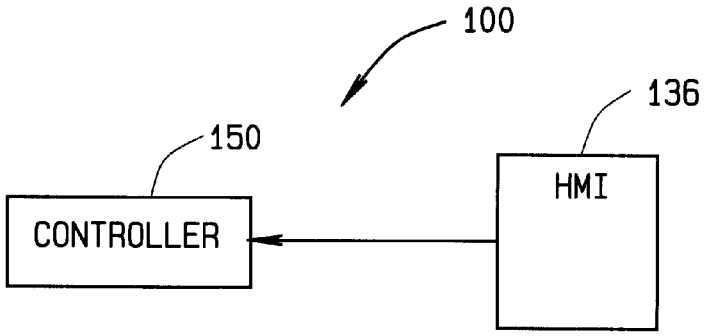
FIG. 2 is a block diagram of a dishwasher control board and human machine interface (HMI)

FIG. 2 is a block diagram of a controller 150, sometimes referred to herein as a dishwasher control board, and human machine interface (HMI) 136 for dishwasher 100. Although a common control board 150 typically is utilized across various dishwasher models, HMI 136 typically is different for each model. Specifically, since the functions and features vary from model to model, the inputs required from the user also vary from model to model.

Since HMI 136 varies from model to model, HMI 136 can be designated to carry an indicator or identifier used by control board 150 with respect to the model dishwasher in which control board 150 is installed. The indicator can take many different forms, and the indicator is not limited to the specific embodiment described herein. For example, rather than a resistor ($R_{model}$) that corresponds to a particular dishwasher model, the indicator can comprise a more complex circuit. In addition, and rather than an electrical circuit component, a mechanical feature could be added to HMI 136 that interfaces with control board 150 to designate a particular model. For example, a flexible connector can extend from HMI 136 to control board 150, and the connector can have a unique pin assignment that corresponds to a particular model dishwasher.

Figure 3:
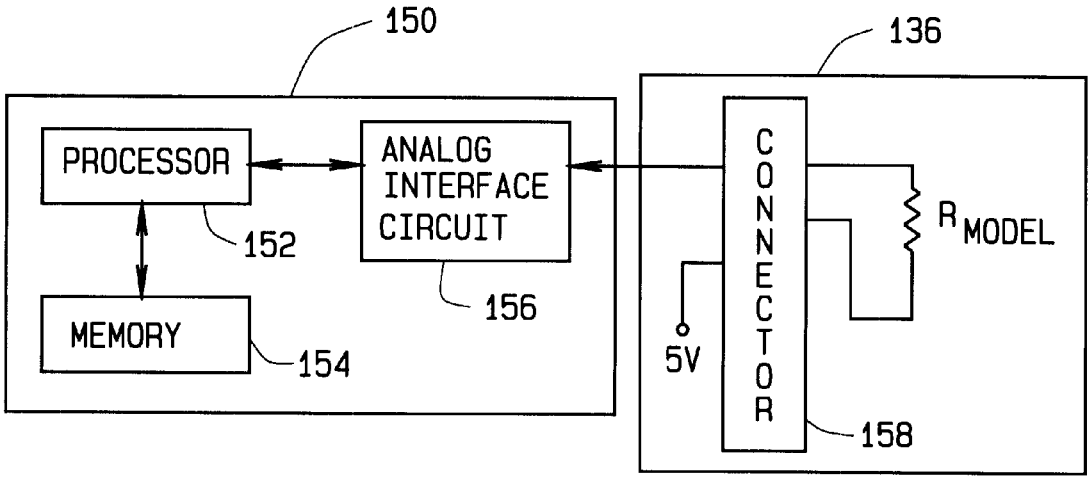
FIG. 3 is a more detailed block diagram of components of the dishwasher control board and HMI shown in FIG. 2.

FIG. 3 is a more detailed block diagram of example components of controller 150 and HMI 136. Controller 150 includes a processor 152, such as a microprocessor coupled to a memory 154 and an analog interface circuit 156. Processor 152 does not necessarily need to be a microprocessor but could be any component (e.g., a logic circuit, an application specific integrated circuit) capable of determining a dishwasher model type based on an indicator carried by HMI 136 as described below in more detail. As explained above, control programs and variables for many different dishwasher models are stored in memory 154. The particular control programs and variables executed and utilized by microprocessor 152 depends upon the particular model dishwasher in which control board 150 is installed.

In accordance with the example embodiment, microprocessor 152 determines which programs and variables to utilize based on an analog input supplied by analog interface circuit 156. HMI 136 is coupled to analog interface circuit 156, and HMI 136 includes a connector 158. A resistor $R_{model}$ is coupled to connector, and a voltage source (5V) also is coupled to resistor $R_{model}$ via connector 158. Resistor $R_{model}$ has a unique value that is selected based on the dishwasher model type in which HMI 136 is to be used.

Prior to use, HMI 136 is assembled to a dishwasher door and is electrically coupled to control board 150. The unique resistor value of resistor $R_{model}$ impacts the magnitude of the voltage signal sampled by microprocessor 152 from analog interface circuit 156. More specifically, microprocessor 152 samples the voltage signal at the output of analog interface circuit 156. Microprocessor 152 then compares the sampled voltage signal with prestored values in memory 154. Once microprocessor 152 identifies a match (or determines that the sampled voltage signal is within one of a plurality of predefined ranges), then the unique model number that corresponds to the matching value or range is determined to be the model type in which control board 150 is mounted. Microprocessor 152 then executes the appropriate control programs using the appropriate variables for that particular dishwasher model.

Figure 4:
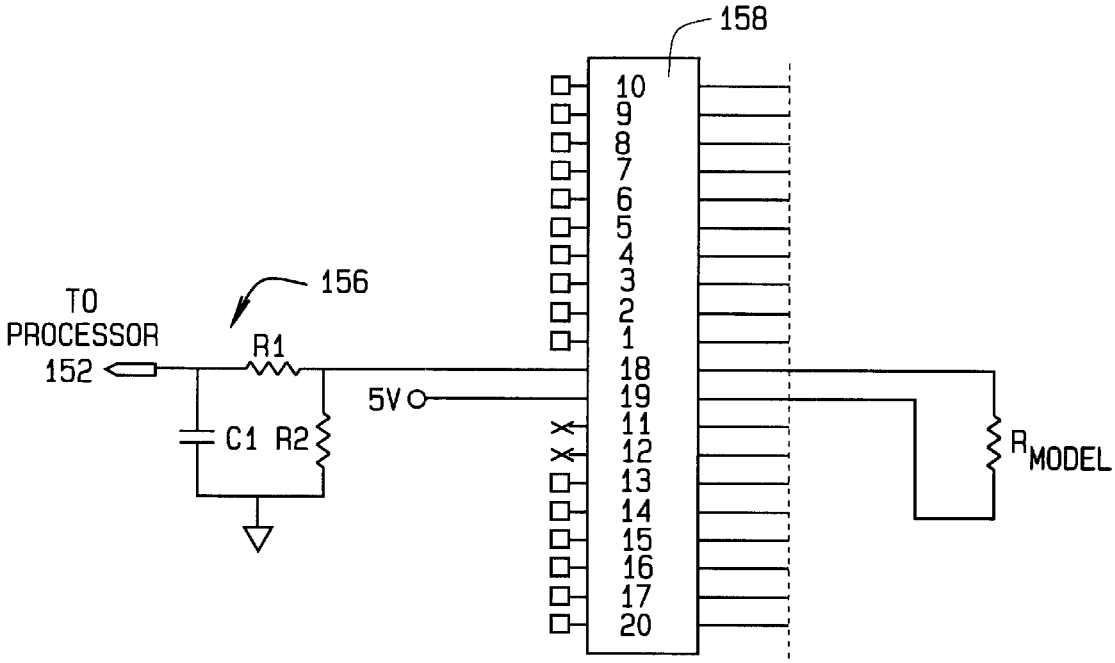
FIG. 4 is a circuit diagram of an analog interface circuit.

FIG. 4 is a circuit diagram of an analog interface circuit 156. Circuit 156 includes resistors R1 and R2 as well as a capacitor C1. Example values for such components are set forth below.

R1: 3.6 k

R2: 3.32 k

C1: 0.1 uF

In the specific implementation as shown in FIG. 4 with the circuit component values as set forth above, the following table is applicable

| Model Number | Resistance | Voltage | lower | upper |
|---|---|---|---|---|
| 0 | open | 0.0000 | | |
| 1 | 130,000 | 0.12380 | 0.0980 | 0.1373 |
| 2 | 75,000 | 0.21069 | 0.1765 | 0.2353 |
| 3 | 47,000 | 0.32798 | 0.2941 | 0.3725 |
| 4 | 30,000 | 0.49541 | 0.4314 | 0.5490 |
| 5 | 22,000 | 0.65207 | 0.5882 | 0.7255 |
| 6 | 16,000 | 0.85790 | 0.7647 | 0.9412 |
| 7 | 12,000 | 1.07827 | 0.9804 | 1.1765 |
| 8 | 9,100 | 1.33045 | 1.2157 | 1.4314 |
| 9 | 6,800 | 1.63345 | 1.4902 | 1.7647 |
| 10 | 5,100 | 1.96405 | 1.8039 | 2.0980 |
| 11 | 3,900 | 2.29143 | 2.1373 | 2.4510 |
| 12 | 2,700 | 2,74980 | 2.5098 | 2.9608 |
| 13 | 1,800 | 3.23516 | 3.0196 | 3.4510 |
| 14 | 1,100 | 3.75000 | 3.4902 | 3.9804 |
| 15 | 560 | 4.39216 | 4.0196 | 5.0000 |

With the fifteen different resistor values for $R_{model}$ fifteen different models are discernible based on the analog interface circuit output signal. For example, with a resistor value of 3,900 ohms (model 11), the voltage value at analog interface circuit output should be about 2.29143 Volts, and in a range of 2.1373 Volts to 2.4510 Volts. The range values are stored in a look-up table in memory 154 and microprocessor 152 determines which model corresponds to the range in which the sampled output voltage is within. For example, if the sampled output voltage from analog interface circuit is 2.2402 Volts, then such voltage is within the range corresponding to model 11. Therefore, microprocessor 152 executes uses the variables for a model 11 type dishwasher.

The above example is expandable. For example, additional pins and resistors can be used to differentiate between more models. If n pins are used with n−1 resistors, then $15^{n-1}$ models can be differentiated.

The voltage ranges are selected so that variances in component values and input voltages can be accommodated.

Accurately selecting the ranges for each model facilitates ensuring the proper program and variables are utilized for the correct dishwasher model. Such ranges can be selected, for example, using empirical data. Also, since the HMI is different for each dishwasher model, the HMI can readily incorporate a unique resistor value corresponding to the particular dishwasher model on which the HMI is to be utilized.

While the invention has been described in terms of various specific embodiments, those skilled in the art will recognize that the invention can be practiced with modification within the spirit and scope of the claims.

What is claimed is:

1. A dishwasher comprising:

a cabinet comprising a tub having a front opening and forming a wash chamber;

at least one rack extending into said wash chamber;

a water pump for pumping water into said dishwasher;

a door engaged to said cabinet for closing said tub front opening;

a human machine interface comprising an indicator corresponding to a model type; and a controller coupled to said human machine interface and configured to control operation of at least said pump based on said model type indicator.

2. A dishwasher according to claim 1 wherein said human machine interface is secured to said door.

3. A dishwasher according to claim 1 wherein said model type indicator comprises a resistor.

4. A dishwasher according to claim 3 wherein said human machine interface comprises a connector and a voltage source, said resistor and said voltage source coupled to said connector.

5. A dishwasher according to claim 1 wherein said controller comprises a processor and a memory, said processor coupled to said memory.

6. A dishwasher according to claim 1 wherein said controller comprises an analog interface circuit, said analog interface circuit coupled to said human machine interface.

7. A method for controlling operation of a dishwasher, the dishwasher comprising controller and a human machine interface, the human machine interface comprising an indicator corresponding to a model type, said method comprising the steps of:

determining a model type based on the indicator; and controlling operation of the controller in accordance with the determined model type.

8. A method according to claim 7 wherein the controller comprises a processor and wherein determining a model type comprises the steps of operating the processor to sample a signal generated based on the indicator.

9. A method according to claim 8 wherein the indicator comprises a resistor, and the controller further comprises an analog interface circuit coupled to the processor and to the resistor, and wherein operating the processor to sample a signal generated based on the indicator comprises the step of operating the processor to sample a voltage signal at an output of the analog interface circuit.

10. A method according to claim 7 where controlling operation of the controller comprises selecting a wash cycle program to be executed by the controller.

11. A kit comprising a human machine interface, said human machine interface comprising an indicator corresponding to a dishwasher model type, said indicator is configured to be coupled to a dishwasher controller.

12. A kit according to claim 11 where said indicator comprises a resistor.

13. A kit according to claim 11 wherein the dishwasher controller comprises a processor coupled to an analog interface circuit, said indicator configured to couple to said analog interface circuit.

14. A kit according to claim 11 wherein said human machine interface is configured to secure to a dishwasher door.

15. A kit according to claim 11 wherein said human machine interface further comprises a connector and a voltage source, said indicator and said voltage source coupled to said connector.

* * * * *